US008561367B2

(12) United States Patent
Kelly

(10) Patent No.: US 8,561,367 B2
(45) Date of Patent: Oct. 22, 2013

(54) PARAPET VENT

(76) Inventor: Robert John Kelly, Deerfield, IL (US)

( * ) Notice: Subject to any disclaimer, the term of this patent is extended or adjusted under 35 U.S.C. 154(b) by 0 days.

(21) Appl. No.: 13/613,237

(22) Filed: Sep. 13, 2012

(65) Prior Publication Data

US 2013/0192154 A1 Aug. 1, 2013

Related U.S. Application Data

(60) Provisional application No. 61/592,463, filed on Jan. 30, 2012.

(51) Int. Cl.

| | |
|---|---|
| ***E04F 19/02*** | (2006.01) |
| ***E04D 13/143*** | (2006.01) |
| ***E04D 13/152*** | (2006.01) |

(52) U.S. Cl.
USPC ..... 52/300; 52/60; 52/96; 52/97; 52/198; 52/302.1

(58) Field of Classification Search
USPC ..... 52/60, 96, 97, 198, 300, 302.1, 302.6, 52/408
See application file for complete search history.

(56) References Cited

U.S. PATENT DOCUMENTS

| | | | | |
|---|---|---|---|---|
| 2,855,776 | A * | 10/1958 | Trostle | 52/97 |
| 3,862,531 | A * | 1/1975 | Attaway et al. | 52/300 |
| RE28,870 | E * | 6/1976 | Attaway et al. | 52/300 |
| 4,083,158 | A * | 4/1978 | Wolma | 52/300 |
| 4,419,850 | A * | 12/1983 | Butzen | 52/60 |
| 4,550,535 | A * | 11/1985 | Drogosch | 52/60 |
| 4,964,248 | A * | 10/1990 | Braine et al. | 52/60 |
| 5,189,853 | A * | 3/1993 | Braine et al. | 52/96 |
| 5,704,176 | A * | 1/1998 | Greenberg | 52/300 |
| 6,786,018 | B2 * | 9/2004 | Webb et al. | 52/300 |
| 7,168,209 | B2 * | 1/2007 | Heidler, Jr. | 52/60 |
| 8,001,739 | B1 * | 8/2011 | Inzeo et al. | 52/300 |
| 2003/0051428 | A1 * | 3/2003 | Kay et al. | 52/566 |
| 2005/0028464 | A1 * | 2/2005 | Kay et al. | 52/300 |
| 2009/0056262 | A1 * | 3/2009 | Kelly | 52/408 |

FOREIGN PATENT DOCUMENTS

| | | | |
|---|---|---|---|
| JP | 2003-206606 | * | 7/2003 |
| JP | 2004-60335 | * | 2/2004 |
| JP | 2005-256474 | * | 9/2005 |

* cited by examiner

*Primary Examiner* — Robert Canfield
(74) *Attorney, Agent, or Firm* — Justin Lampel

(57) ABSTRACT

A water vapor release and moisture seal device for use in association with brick, wood, stone, and cement or concrete masonry unit (CMU) buildings is provided. The device has a first layer metal housing and second layer metal housing which are inserted over the top of the parapet walls of a flat or slightly slanted-roofed building. A water resistant cloth and mesh material layer is inserted between the metal housings. A fastener secures the second layer metal housing to parapet wall of the building in two places, once each on the exterior and interior of the parapet wall. The housings interlock with each other on the exterior side of the wall and with a fastener on the interior side of the wall. The device is secured to the top of a wall of a building and allows the wall to breathe properly and eliminate moisture.

12 Claims, 8 Drawing Sheets

PARAPET VENT

BASED ON PROVISIONAL

The following application is based on U.S. provisional patent application 61/592,463 filed on Jan. 30, 2012. The present application claims priority to the '463 application, the entire contents of which are incorporated by reference.

BACKGROUND OF THE INVENTION

A water vapor release and moisture seal device for buildings is provided. The water vapor release and moisture seal device is especially suitable for use in association with brick, wood, stone, and cement or concrete masonry unit (CMU) buildings. The water vapor release and moisture seal device has a first layer metal housing and second layer metal housing which are inserted over the top of the parapet walls of a flat or slightly slanted-roofed building. A water resistant cloth and mesh material layer is inserted between the first layer metal housing and second layer metal housings. A fastener secures the second layer metal housing to parapet wall of the building in two places, once each on the exterior and interior of the parapet wall. The first layer metal housing and second layer metal housing interlock with each other on the exterior side of the wall and with a fastener on the interior side of the wall. The device is secured to the top of a wall of a building and allows the wall to breathe properly and eliminate moisture. Often attempts to seal water out of a building have the effect of also sealing water into a building. Over time this can result in extensive damage to the floors and walls of a building. In more extreme cases, the damage can result in the floors and ceiling joists collapsing causing serious damage to the building and even death.

U.S. Pat. No. 8,001,739 to Inzeo discloses a parapet wall cover system having a clip support, at least one spring support clip and a cover channel. The at least one spring support clip is attached to a top of the clip support channel. The cover channel includes a top surface, a first side surface and a second side surface. The parapet cover system is preferably attached to a parapet wall in the following manner. The clip support is attached to a top of the parapet wall. The at least one spring support clip is secured to the clip support. The cover channel is pushed on to either the clip support channel or the at least one spring support clip and is retained thereby. A vented parapet cover system includes a perforated clip support. A perforated closure may be substituted for the perforated support channel.

U.S. Publication No.: 20050028464 to Kay discloses a coping assembly having a first elongated coping section, a second elongated coping section, and a splice plate. The first coping section includes an end and is mounted on the top of the wall to cover a first portion of a wall. The second coping section includes an end and is mounted on the top of the wall to cover a second portion of the wall. The second coping section is positioned in an end to end relationship with the first coping section and spaced from the first coping section. The splice plate is positioned beneath a portion of the first and second coping sections and includes a portion that extends between the first and second coping sections. The portion of the splice plate includes a formed groove that has the appearance of a mortar reveal.

U.S. Pat. No. 4,083,158 to Wolma discloses a coping mounting plate for mounting a coping member to a building parapet, wall or the like which extends above a roof deck. The width of the coping mounting plate is adjustable by a plurality of interlocking keys and keyways for accommodating different wall thicknesses.

However, these patents and publications fail to describe a water vapor release and moisture seal device for use in association with walls of a building wherein the walls of a building can eliminate moisture effectively. Further, these patents and publications fail to describe a water vapor release and moisture seal device for a building wherein the walls of the building can eliminate moisture properly.

SUMMARY OF THE INVENTION

A water vapor release and moisture seal device for buildings is provided. The water vapor release and moisture seal device is especially suitable for use in association with brick, wood, stone, and cement or concrete masonry unit (CMU) buildings. The water vapor release and moisture seal device has a first layer metal housing and second layer metal housing which are inserted over the top of the parapet walls of a flat or slightly slanted-roofed building. A water resistant cloth and mesh material layer is inserted between the first layer metal housing and second layer metal housings. A fastener secures the second layer metal housing to parapet wall of the building in two places, once each on the exterior and interior of the parapet wall. The first layer metal housing and second layer metal housing interlock with each other on the exterior side of the wall and with a fastener on the interior side of the wall. The device is secured to the top of a wall of a building and allows the wall to breathe properly and eliminate moisture.

An advantage of the present water vapor release and moisture seal device for a building is that the present water vapor release and moisture seal device allows the walls of a building to breathe properly.

Still another advantage of the present water vapor release and moisture seal device for a building is that the present water vapor release and moisture seal device allows for moisture within the building to properly be removed from the building.

Yet another advantage of the present water vapor release and moisture seal device for a building is that the present water vapor release and moisture seal device is a guard from preventing wind driven rain from entering the building.

Another advantage of the present water vapor release and moisture seal device for a building is that the present water vapor release and moisture seal device may be altered depending on the size of the walls of the buildings.

Still an advantage of the present water vapor release and moisture seal device is that two fasteners are completely concealed within the device, being applied to the wall through the second layer only. A third fastener is applied on the interior side, through the first layer into the second layer (resting on the wall) but not driven into the wall. A return conceals the fastener from view and the elements, therein reducing moisture exchange.

And another advantage of the present water vapor release and moisture seal device for a building is that the present water vapor release and moisture seal device has a first layer and a second layer which surrounds a crush resistant polymer water resistant cloth and polyester non-woven mesh material layer which allows for the release of water vapor out of the building walls and does not allow water to enter or re-enter the building walls.

Still another advantage of the present water vapor release and moisture seal device for a building is that the present water vapor release and moisture seal device has a perforated, slanted second layer and extended kickout on the exterior side for moving moisture and condensation out of the interior of a building.

An advantage of the present water vapor release and moisture seal device for a building is that the device allows water vapor to dissipate out of the wall cavity (at the top and on the exterior side) like a chimney instead of the water vapor having to travel through the face of the brick, stone or wood. As a result, mold and damage to the building is reduced on the interior wall cavity components (joists, studs, insulation and drywall) and therefore less damage to the building occurs.

For a more complete understanding of the above listed features and advantages of the present water vapor release and moisture seal device for buildings, reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

A water vapor release and moisture seal device for buildings is provided. The water vapor release and moisture seal device is especially suitable for use in association with brick, wood, stone, and cement or concrete masonry unit (CMU) buildings. The water vapor release and moisture seal device has a first layer metal housing and second layer metal housing which are inserted over the top of the parapet walls of a flat or slightly slanted-roofed building. A water resistant cloth and mesh material layer is inserted between the first layer metal housing and second layer metal housings. A fastener secures the second layer metal housing to parapet wall of the building in two places, once each on the exterior and interior of the parapet wall. The first layer metal housing and second layer metal housing interlock with each other on the exterior side of the wall and with a fastener on the interior side of the wall. The device is secured to the top of a wall of a building and allows the wall to breathe properly and eliminate moisture.

The present water vapor release and moisture seal device for a building allows water vapor to dissipate out of the wall cavity (at the top) like a chimney instead of the water vapor having to travel through the face of the brick, stone or wood. The water vapor is generally created from several different sources including: rain, snow, humidity, and condensation created from the building's air conditioning cooling the warm air inside the building. As a result of the present device, mold and damage to the building is reduced as the device allows the water vapor to exit the building while at the same time keeping wind driven rain out of the building.

Figure 1:
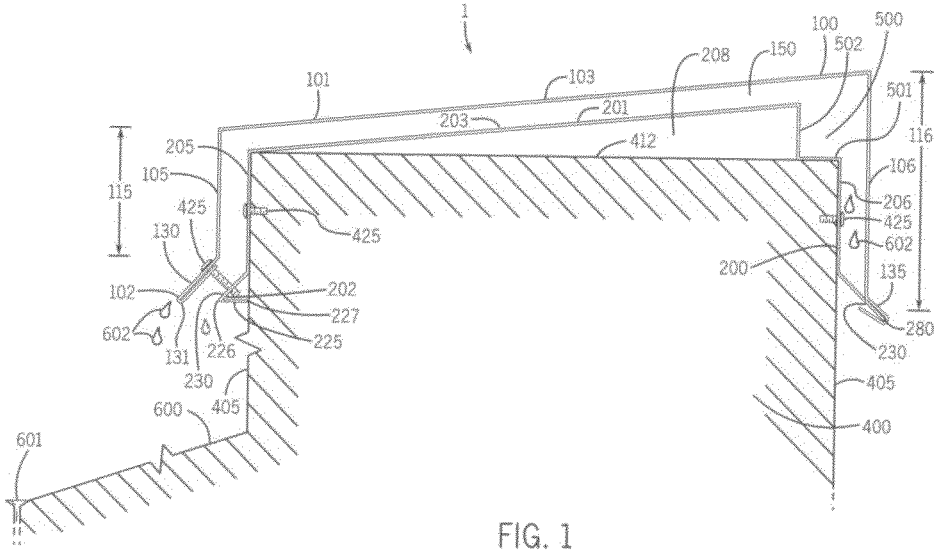
FIG. 1 illustrates a side view of the first layer secured over the second layer wherein both layers are secured to a wall of a building.

Referring now to FIG. 1, a water vapor release and moisture seal device 1 for walls of a building is provided. The water vapor release and moisture seal device 1 may have a first layer 100 (also called a "top flashing" or "coping") and a second layer 200 (also called a "bottom flashing" or "continuous coping clip"). In an embodiment, the first layer 100 and second layer 200 are constructed from a metal such as, for example, steel or aluminum. Preferably, a corrosion-resistant Fluropon coating is applied (such as a Kynar 500 or Hylar 5000 coating) to the first layer 100 and possibly second layer 200 so that the first layer 100 and second layer 200 may be further resistant to corrosion.

Figure 2:
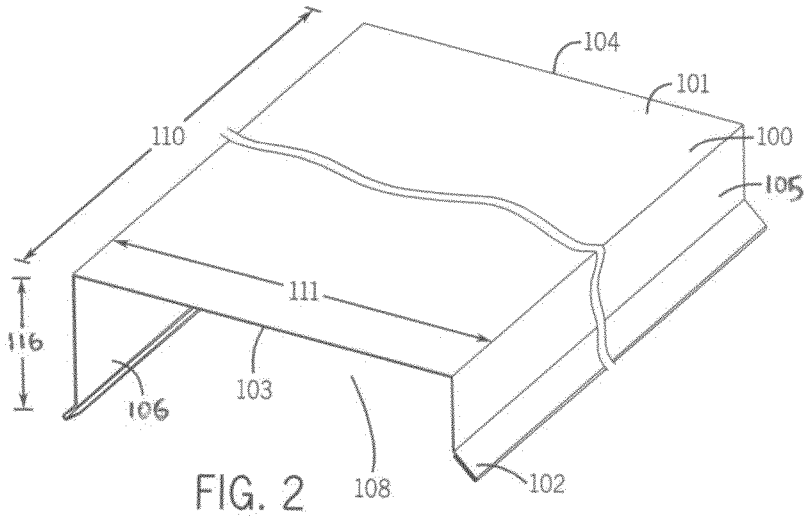
FIG. 2 illustrates a perspective view of the first layer of the device.

The first layer 100 may have a top 101, a bottom 102, a front 103, a back 104 (FIG. 2), a first side 105 and a second side 106. An interior 108 of the first layer 100 may be defined between the top 101 and the bottom 102, the front 103 and back 104, and the first side 105 and the second side 106. The dimensions of the first layer 100 and second layer 200 and the corresponding tops, bottoms, fronts, backs and sides may vary depending on the size of the walls 400 (FIG. 3) of the buildings 401 for which the device 1 is used in association with.

Figure 3:
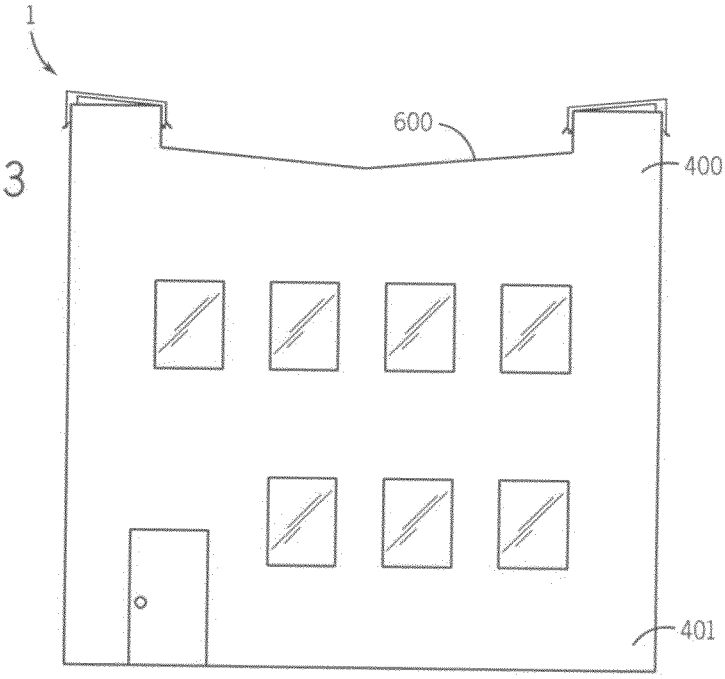
FIG. 3 illustrates a side view of a building wherein the device is installed over the walls of the buildings.
Figure 4:
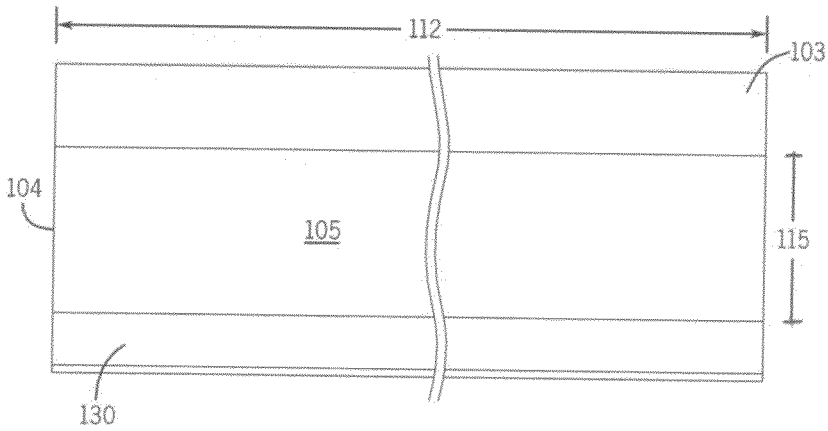
FIG. 4 illustrates a side view of the first side of the first layer of the device.

In an embodiment, the first side 105 of the first layer 100 may have a height 115 which is less than a height 116 of the second side 106 of the first layer 100. As a result, the top 101 of the first layer 100 may be slanted toward the roof 600 of a building 401 (FIG. 3). Having the top 101 of the first layer 100 slanted toward the roof 600 of a building 401 further allows condensation and moisture 602 to roll off the top 101 of the first layer 100 onto the roof 600 wherein the condensation and moisture 602 can be drained onto a drainage pipe 601 of the roof 600 and off the building 401. Further, in an embodiment, the roof 600 may be slightly slanted inward, toward the center of the building 401 so as to better drain the condensation and moisture 602. The top 101 (FIG. 2) of the first layer 100 may be generally rectangular and may have a length 110 and a width 111. The first side 105 of the first layer 100 may be generally rectangular and may have a length 112 (FIG. 4) and a height 115.

The second layer 200 may have a top 201 (FIG. 6), a bottom 202, a front 203, a back 204, a first side 205 and a second side 206 (FIG. 1). An interior 208 (FIG. 1) of the second layer 200 may be defined between the top 201, the bottom 202, the front 203, the back 204, the first side 205 and the second side 206 of the second layer 200.

The first side 205 of the second layer 200 may have an extended lip portion 230 (FIG. 1). The extended lip portion 230 may extend slightly outward from the first side 205 of the second layer 200 and may then turn back inward forming a "V-like" cross section. The bottom 225 of the extended lip portion 230 may have a first end 226 and a second end 227. The first end 226 of the bottom 225 of the extended lip portion 230 may allow moisture 602 to fall away from the wall 400 while the second end 227 of the bottom 225 may directly contact the wall 400 of the building 401. More specifically, the second end 227 of the bottom 225 may provide a contact point against the wall 400 so as to properly position the second layer 200 with respect to the wall 400. In use, the bottom 225 of the extended lip portion 230 remains substantially horizontal with respect to the ground. In an embodiment, the extended lip portion 230 may have a plurality of openings 220 (discussed below).

Figure 5:
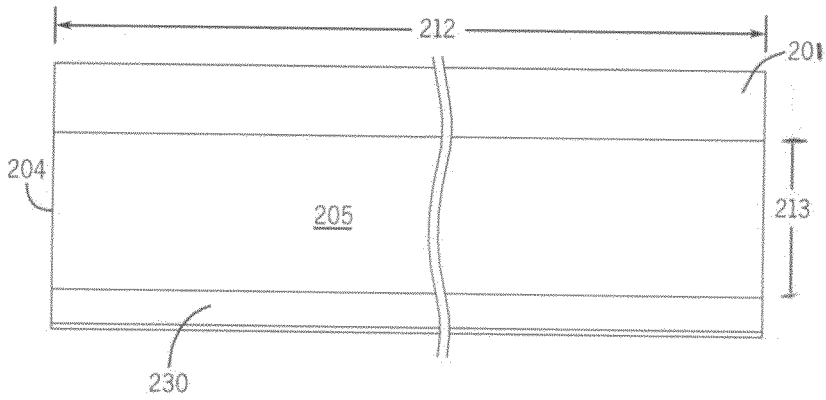
FIG. 5 illustrates a side view of the first side of the second layer of the device.

The top 201 of the second layer 200 may be generally rectangular in shape and may have a length 210 (FIG. 6) and a width 211. The first side 205 of the second layer 200 may be generally rectangular and may have a length 212 (FIG. 5) and a width 213.

Figure 6:
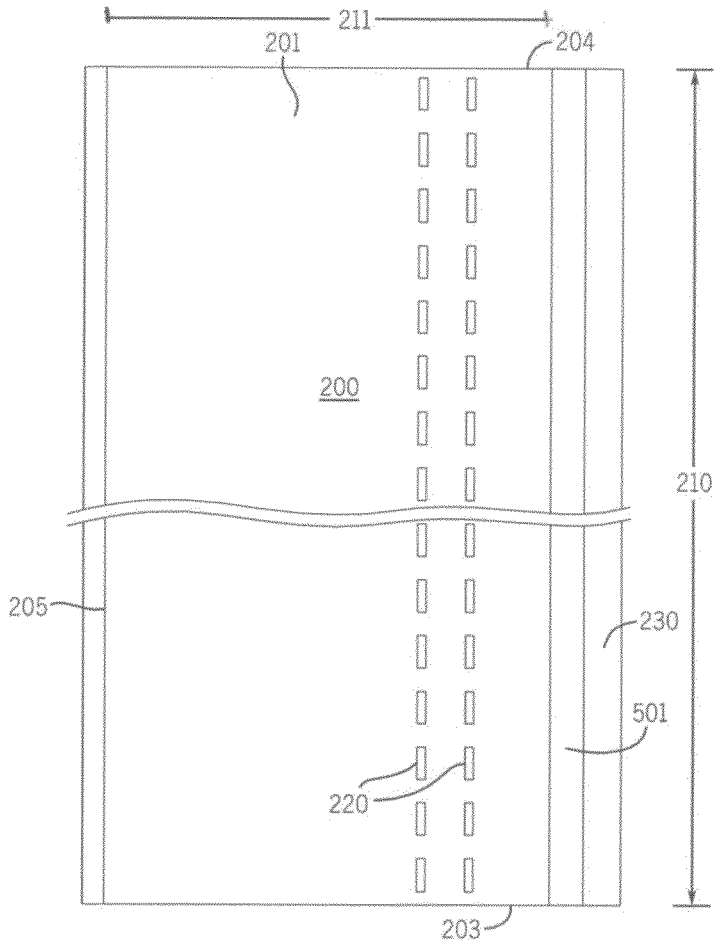
FIG. 6 illustrates a top view of the second layer.

Referring to FIG. 6, the top 201 of the second layer 200 may have a plurality of openings 220 (or "perforations"). The plurality of openings 220 may be generally rectangular and may run substantially parallel to the length 210 of the top 201 of the second layer 200. In an embodiment, there are two sections of perforations 220 equally spaced on the top 201 with four rows of perforations 220 each. The plurality of openings 220 may allow the walls 400 of the building 401 to breathe properly and may allow a water resistant material 300 (defined below) to work properly. In an embodiment, the water resistant material 300 may not actually get wet and may be non-absorbent.

In an embodiment, a recessed portion 500 (FIG. 1) extends downward from the top 201 and second side 206 of the second layer 200. The recessed portion 500 may be generally square-shaped in a cross section and may run the entire length 212 of the second layer 200. The recessed portion 500 may have a sill portion 501 and a pitch portion 502. The sill portion 501 may provide a surface for a portion of the second layer 200 to rest upon and further provides the main contact surface between the second layer 200 and the top 412 of the wall 400. The pitch portion 502 may elevate the second side 206 and the top 201 of the second layer 200 higher than the first side 205 of the second layer 200 so that the top 201 of the second layer 200 is slanted over the top 412 of the wall 400. This allows the moisture 602 to properly drain off the top 201 of the second layer 200. Preferably, the sill portion 501 and the pitch portion 502 are at approximately ninety degrees with respect to each other.

Figure 7:
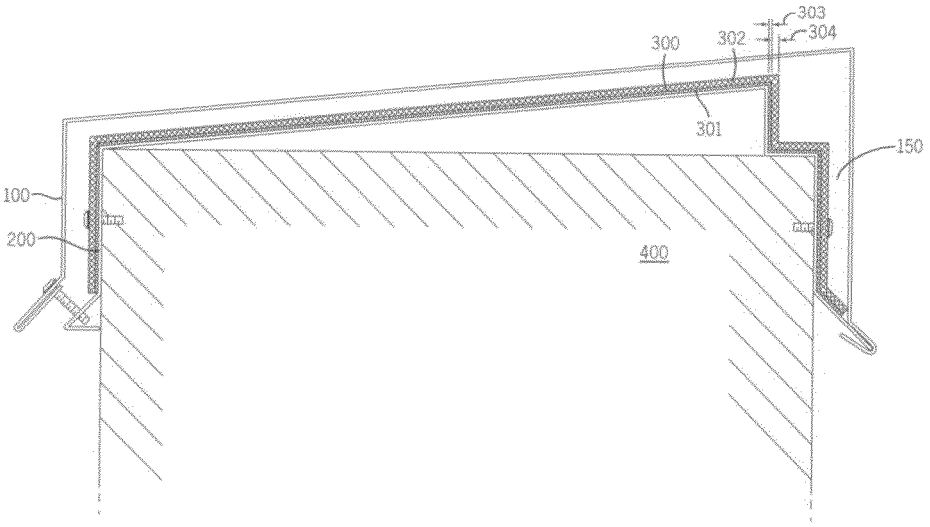
FIG. 7 illustrates a side view of the device wherein the mesh water resist material is present.
Figure 8:
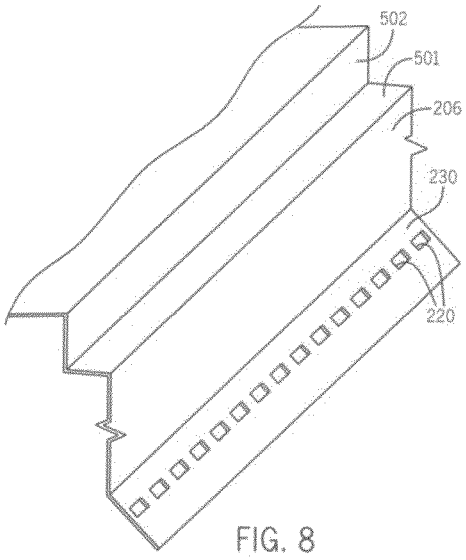
FIG. 8 illustrates a perspective view of the exterior side (also called a "leg") of the second layer.

In use, the first layer 100 may be located above the second layer 200. More specifically, the second layer 200 may be located closer to the top 412 of the wall 400 (and ground) than the first layer 100. A space 150 (FIG. 1) may be located between the first layer 100 and the second layer 200 (on both the top and sides). More specifically, the space 150 may run parallel to the first layer 100 and the second layer 200 and may further extend along the length of the sides of the first layer 100 and the second layer 200. As stated above, located within the space 150 between the underside of the top 101 of the first layer 100 and the top 201 of the second layer 200 may be a water resistant material 300 (FIG. 7). Capillary action may act as a wick an may pull the vapor up and out of the plurality of openings 220 at the top 201 of the second layer 200 and may therein releases the water vapor from the building 401. In an embodiment, the water resistant material 300 may be located on the top 201 of the second layer 200 and on the sides of the second layer. The water resistant material 300 may act as a barrier to entry and re-entry of moisture.

Referring to FIG. 7, the water resistant material 300 may have a first layer 301 and a second layer 302. The first layer 301 may be permeable by water vapor, both up and down, but not permeable by water (water molecules are too large). The first layer 301 may be made from a material such as non-woven polyester with a permeability rating of at least 247 and may act as a rain screen cloth. The second layer 302 of the water resistant material 300 may be made from a polymer mesh-like structure. In an embodiment the first layer 301 of the water resistant material 300 may be secured to the second layer 302 of the water resistant material 300 by, for example, an adhesive such as glue.

The first layer 301 of the water resistant material 300 may have a height 303 and the second layer 302 of the water resistant material 300 may have a height of 304. The height 303 of the first layer 301 of the water resistant material 300 may be substantially less than the height 304 of the second layer 302 of the water resistant material 300. The first layer 301 of the water resistant material 300 may allow moisture or vapor 602 to rise up from the wall 400 while also preventing the moisture or vapor 602 from entering the wall 400.

In use, second layer 302 (the mesh layer) of the water resistant material 300 may be located above, and may contact, the first layer 301 of the water resistant material 300. In an embodiment, the second layer 302 may have a height between 9 mm and 13 mm. The first layer 301 of the water resistant material 300 may directly contact the second layer 200 of the device 1. In an embodiment, the second layer 302 of the water resistant material 300 is in contact with the underside of the first layer 100 of the device 1 (not shown). The mesh of the second layer 302 of the water resistant material 300 may allow air circulation through the device 1. The second layer 302 of the mesh may be constructed as a matrix of tangled monofilaments having varying thicknesses; which are tough and resistant to being crushed.

The first layer 100 may be slightly greater in size than the second layer 200. More specifically, the width 211 (FIG. 6) of the top 201 of the second layer 200 may be slightly less than the width 111 (FIG. 2) of the top 101 of the first layer 100 such that second layer 200 may be largely inserted into the underside of the first layer 100.

The first side 105 of the first layer 100 may have an extended lip portion 130 (FIG. 1) having a folded back smooth portion 131 (or hemmed portion). The purpose of the hemmed edge is to protect the finger of the installers and finish the piece, enclosing it within the device and further reducing corrosion possibilities. The extended lip portion 130 of the first layer 100 may act as a securing mechanism in that the extended lip portion 130 of the first layer 100 may provide a surface for a fastener 425 (described below) to be secured to the second layer 200. In addition to allowing the first layer 100 to be secured to the second layer 200, the extended lip portion 130 of the first side 105 of the first layer 100 may further allow rain or moisture 602 to be drained or otherwise moved away from the wall 400.

To install the device 1 onto a building 401, the installer first places the second layer 200 over the top 412 of a wall 400 of a building 401. Generally, the device 1 is used only in connection with buildings 401 having a generally flat or slightly inward slanted roof 600. FIG. 1 illustrates the wall 400 being located slightly above the level of the roof 600; however, the top 412 of the wall 400 may be located substantially higher than the top of the roof 600. On the wall 400 of the building 401 (the wall 400 facing the outside of the building 401), the installer first uses a tool (such as a hammer) to secure an anchor pins or fastener 425 (FIG. 1) through the second side 206 of the second layer 200 through to the (outside facing) side wall 400 of the building 401. A second fastener 425 is used to then secure the first side 205 of the second layer 200 to the wall 400 (the side of the wall 400 facing the interior of the building 401) of the building 401. Once the second layer 200 is secured over the top 412 of the wall 400, the water resistant material 300 is inserted over the second layer 200 and then the first layer 100 is placed over the water resistant material 300.

The first layer 100 may then be secured to the second layer 200. To accomplish this, a third fastener 425 is secured through the extended lip portion 130 of the first layer 100 through to the first side 205 of the second layer 200.

In an embodiment, the two internal fasteners 425 may be placed approximately every twenty-four (24) inches apart from each other along the length of the device 1, or if necessary, closer together to secure the device 1. The fasteners 425 may be similar to a typical Rawl® anchor fastener. More specifically, the fasteners 425 may have an anchor portion and a pin (or screw) portion. As a result of having very few fasteners 425 extending through the uppermost surface (the first layer 100), and no fasteners 425 on the top 103 of the first layer 100, the number of exposed openings present on the outside of the device 1 (wherein water can gain access to the interior of the device 1) is greatly reduced.

As the pin is driven into the wall 400, the anchor pin expands within the wall 400 and anchors the second layer 200 in place over the top 412 of the wall 400. Because the fasteners 425 are substantially located between the second layer 200 and the wall 400, instead of through the exposed first layer 100 (except for the fastener 425 located extended lip portion 130 of the first layer 100), the device 1 has fewer possible points of entry for water or water vapor to enter the device 1.

In an embodiment, a third fastener may be used to further secure the device 1 to the building 401. The third fastener may be applied through the first layer 100 into the second layer 200 and may rest on the wall 400. The third fastener may be concealed by the bottom 225 of the extended lip portion 230.

Once the second layer 200 is placed over the wall 400, the water resistant material 300 is then placed over the second layer 200. In an embodiment, the water resistant material 300 may be secured into place on the second layer 200 by, for example, glue. The water resistant material 300 is placed mesh side up on the second layer 200. The first layer 100 is then placed over the mesh material of the water resistant material 300.

Figure 9:
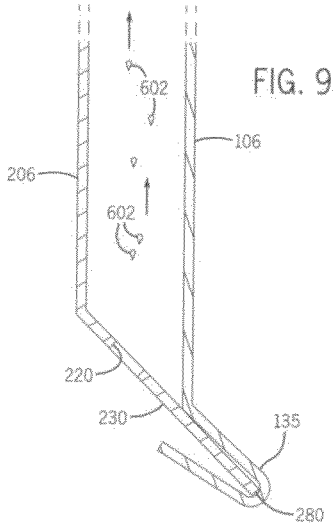
FIG. 9 illustrates a close up of the space between the second side of the first layer and the second side of the second layer.

Referring now to FIG. 9, a space between the second side 206 of the second layer 200 and the second side 106 of the first layer 100 is illustrated. The space allows the water vapor 602 to be released and moisture to rise upward and out of the device 1. As a result, the device 1 helps water vapor to dissipate out of the wall cavity.

The second side 106 of the first layer 100 may have an extended lip portion 135. The extended lip portion 135 of the first layer 100 may slightly resemble the extended lip portion 230 of the first side 205 of the second layer 200. The extended lip portion 135 of the second side 106 of the first layer 100 may bend upward forming two substantially similar layers and may help secure the end 280 of the second side 206 of the second layer 200 between the two similar layers. More specifically, as the extended lip portion 135 of the first layer 100 bends upward, the extended lip portion 135 of the first layer 100 substantially surrounds and interlocks with the end 280 of the second side 206 of the second layer 200.

In use, the first side 205 and the second side 206 of the second layer 200 cover a portion of the sides 450 of the walls 400 of the building 401. Further, in use, the first side 105 of the first layer 100 substantially covers the first side 205 of the second layer 200 and the second side 106 of the first layer 100 substantially covers the second side 206 of the second layer 200. As a result, not only is the top 412 of the wall 400 of the building 401 protected, but also a portion of the walls 400 of the building 401 which extend upward from the surface of the roof 600 of the building 401.

More specifically, in an embodiment, a portion (around three inches) of the wall 400 of a building 401 from the top 412 (which is entirely covered) of the wall 400 downward is covered by the device 1. In addition, the length 112 of the first layer 100 and the length 212 of the second layer 200 are substantially equal to and cover substantially the entire length of the exterior walls 400 of the building 401.

Figure 10:
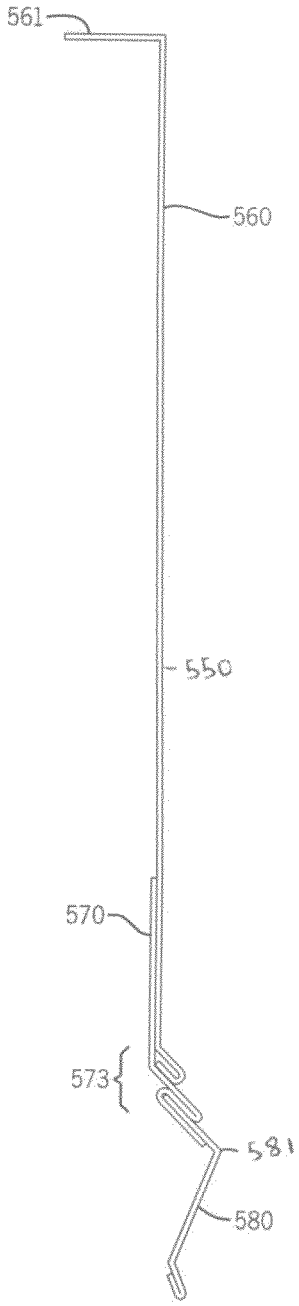
FIG. 10 illustrates an optional protective barrier which is secured to the wall of a building under the device.
Figure 11:
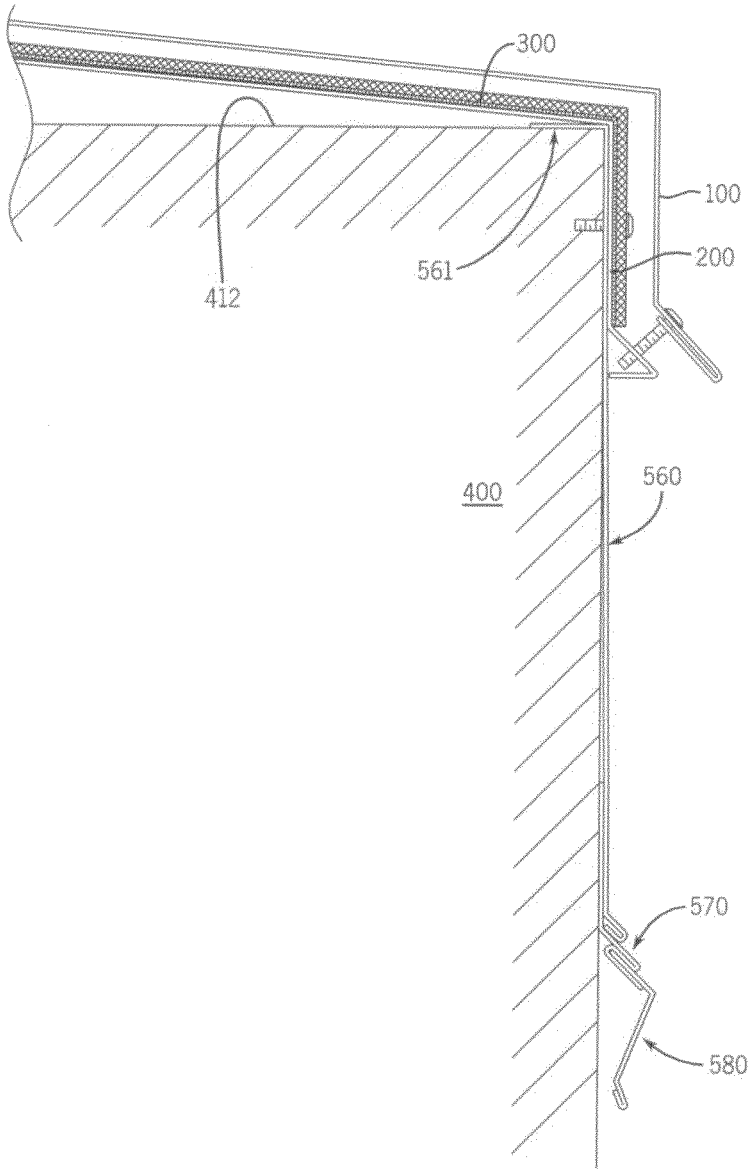
FIG. 11 illustrates a side view of the first layer secured over the second layer wherein both layers are secured to a wall of a building and wherein the optional protective barrier is present on the wall of the building.

Referring now to FIGS. 10 and 11, in an embodiment, an optional protective barrier 550 may be located directly next to and attached to the interior side wall 400 of the building 401 prior to installation of the device 1 onto the walls 400 of the building 401. The optional protective barrier 550 may have three sections, which include: a skirt section 560, receiver clip section 570, and a removable counter flashing section 580. The optional protective barrier 550 may be made of the same material (preferably a corrosion resistant metal) as the first layer 100 and second layer 200.

The skirt section 560 may have a top surface 561 and a side surface 562. The skirt section 560 may help seal out moisture from the building 401. The top surface 561 of the skirt section 560 may directly contact and be secured to a small portion of the top 412 of the wall 400. The side surface 562 of the skirt section 560 may be in direct contact with the interior side of the wall 400 of the building 401. The skirt section 560 may be connected to and may overlap with the receiver clip section 570. The receiver clip section 570 may extend downward from the skirt section 560 and may overlap and secure the apron section 580 via a securing mechanism 573 located on the receiver clip section 570.

The receiver clip section 570 is placed under the skirt section 560 and is positioned above the removable counter flashing section 580. The receiver clip section 570 acts as a barrier between the wall 400 and the end of the skirt section 560. The removable counter flashing section 580 has a knock-out portion 581 which diverts moisture away from the wall 400 of the building 401 and covers and protects the termination of the roofing material. The removable counter flashing section 580 is clipped into the receiver clip section 570 and fastened with a removable fastener and which allows for the easy removal of the removable counter flashing section 580 from the wall 400 for servicing without destroying the permanent sheet metal.

Referring now to FIG. 11, in the embodiment with the optional protective barrier 550, the optional protective barrier 550 is first secured to the wall 400 of the building 401. In an embodiment, the optional barrier 550 may cover the height of the wall 400 from the roofing material termination point up to the device 1. Once properly installed, the device 1 may be installed over the optional protective barrier 550 therein covering the top portion of the optional protective barrier 550.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. A parapet vent for a building comprising:

a housing having a first layer having a top surface, a first side, a second side and an open bottom;

a second layer having a top surface, a first side, a second side and an open bottom wherein the first layer is located above the second layer and wherein a space is created between the first layer and the second layer wherein water vapor may pass through the space and wherein the second layer and first layer are secured to and located above a top surface of a wall of a building and wherein a portion of the wall is located within the open bottom of the second layer;

a securing mechanism securing the first layer to the second layer and wherein the second layer is secured closer to the wall of the building than the first layer;

a square-shaped cross-sectioned recessed portion forming a sill portion and a pitch portion wherein the square-shaped cross sectioned recessed portion extends downward from the top surface and the second side of the second layer and extending an entire length of the second side of the second layer; and wherein the sill portion rests upon a top of the wall and wherein the pitch portion elevates the second side of the second layer higher than the first side of the second layer.

2. The parapet vent of claim 1 further comprising:

a plurality of openings located on the top surface of the second layer wherein the plurality of openings allows for water vapor to pass through the second layer.

3. The parapet vent of claim 1 wherein the first side of the first layer has a height which is less than a height of the second side of the first layer and wherein the top surface of the first layer is slanted and positioned at a nonparallel angle with respect to the top of the wall of the building.

4. The parapet vent of claim 1 wherein the first side of the second layer has a height which is less than a height of the second side of the second layer.

5. The parapet vent of claim 1 further comprising:

an extended lip portion located on the second side of the first layer wherein the extended lip portion has a first surface and a second surface and wherein the first surface and the second surface are substantially similar in size and shape and wherein the first surface and second surface create a pocket for securing an end of the second side of the second layer.

6. The parapet vent of claim 1 further comprising:

a water resistant material layer located between the first layer and the second layer.

7. The parapet vent of claim 6 wherein the water resistant material layer has a first layer which is permeable by water vapor and impermeable by water and a second layer made from a polymer mesh-like structure.

8. The parapet vent of claim 1 further comprising:

a protective covering located between the second layer and the wall of the building wherein the protective layer has a skirt section, a receiver clip section, and a removable counter flashing section.

9. The parapet vent of claim 1 wherein the first layer and second layer have a protruding surface extending out away from the wall of the building wherein the protruding surface of the first layer and second layer force water to run off the first layer and second layer away from the wall of the building.

10. A parapet vent for a building comprising:

a housing having a first layer having a top surface, a first side, a second side and an open bottom;

a second layer having a top surface, a first side, a second side and an open bottom wherein the first layer is located above the second layer and wherein a space is created between the first layer and the second layer wherein water vapor may pass through the space and wherein the second layer and first layer are secured to and located above a top surface of a wall of a building and wherein a portion of the wall is located within the open bottom of the second layer;

a securing mechanism securing the first layer to the second layer and wherein the second layer is secured closer to the wall of the building than the first layer; and a first extended planar surface which extends from the second side of the second layer toward the first side of the second layer wherein the extended planar surface rests substantially parallel to a top surface of the wall and wherein the extended planar surface rests upon the top surface of the wall and a second extended planar surface which extends upward at approximately ninety degrees from the first extended planar surface and wherein the second extended planar surface is in direct contact with and elevates the top surface of the second layer at the second side of the second layer.

11. A parapet vent for a building comprising:

a housing having a first layer having a top surface, a first side, a second side and an open bottom;

a second layer having a top surface, a first side, a second side and an open bottom wherein the first layer is located above the second layer and wherein a space is created between the first layer and the second layer wherein water vapor may pass through the space and wherein the second layer and first layer are secured to and located above a top surface of a wall of a building and wherein a portion of the wall is located within the open bottom of the second layer;

a securing mechanism securing the first layer to the second layer and wherein the second layer is secured closer to the wall of the building than the first layer;

a water resistant material layer located between the first layer and the second layer; and wherein the water resistant material layer has a first layer which is permeable by water vapor and impermeable by water and a second layer made from a polymer mesh-like structure.

12. A parapet vent for a building comprising:

a housing having a first layer having a top surface, a first side, a second side and an open bottom;

a second layer having a top surface, a first side, a second side and an open bottom wherein the first layer is located above the second layer and wherein a space is created between the first layer and the second layer wherein water vapor may pass through the space and wherein the second layer and first layer are secured to and located above a top surface of a wall of a building and wherein a portion of the wall is located within the open bottom of the second layer;

a securing mechanism securing the first layer to the second layer and wherein the second layer is secured closer to the wall of the building than the first layer; and a protective covering located between the second layer and the wall of the building wherein the protective layer has a skirt section, a receiver clip section, and a removable counter flashing section.

* * * * *